US008664842B2

(12) United States Patent
Tanaka et al.

(10) Patent No.: US 8,664,842 B2
(45) Date of Patent: Mar. 4, 2014

(54) SPARK PLUG

(75) Inventors: Tomoo Tanaka, Kitanagoya (JP); Tsutomu Shibata, Owariasahi (JP); Osamu Yoshimoto, Inazawa (JP); Takaaki Kikai, Ama (JP); Takehito Kuno, Nagoya (JP); Kenji Nunome, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/515,627

(22) PCT Filed: Jan. 11, 2011

(86) PCT No.: PCT/JP2011/000078

§ 371 (c)(1),
(2), (4) Date: Jun. 13, 2012

(87) PCT Pub. No.: WO2012/056598

PCT Pub. Date: May 3, 2012

(65) Prior Publication Data

US 2012/0293061 A1 Nov. 22, 2012

(30) Foreign Application Priority Data

Oct. 26, 2010 (JP) ..... 2010-239610

(51) Int. Cl.

| | |
|---|---|
| ***H01T 13/20*** | (2006.01) |
| ***H01T 13/32*** | (2006.01) |
| ***H01T 13/39*** | (2006.01) |
| ***H01T 1/22*** | (2006.01) |

(52) U.S. Cl.
USPC ..... 313/141; 313/143

(58) Field of Classification Search
USPC ..... 313/118–145
See application file for complete search history.

(56) References Cited

U.S. PATENT DOCUMENTS

| | | | | |
|---|---|---|---|---|
| 5,514,929 | A * | 5/1996 | Kawamura | 313/141 |
| 6,523,515 | B2 * | 2/2003 | Kanao | 313/141 |
| 2001/0025617 | A1 | 10/2001 | Kanao | |
| 2006/0170320 | A1 | 8/2006 | Kumagai et al. | |
| 2009/0009048 | A1 | 1/2009 | Yoshimoto et al. | |
| 2009/0107440 | A1 * | 4/2009 | Lykowski et al. | 313/141 |
| 2010/0096968 | A1 * | 4/2010 | Ban et al. | 313/141 |
| 2012/0013241 | A1 | 1/2012 | Shibata et al. | |

FOREIGN PATENT DOCUMENTS

| | | | |
|---|---|---|---|
| CN | 1815830 | A | 8/2006 |
| CN | 102597284 | A | 7/2012 |
| JP | 11-185928 | A | 7/1999 |
| JP | 2001351761 | A | 12/2001 |

(Continued)

OTHER PUBLICATIONS

Office Action dated Jan. 25, 2013, issued by the Japanese Patent Office in counterpart Japanese Application No. 2011-520483.

(Continued)

*Primary Examiner* — Mariceli Santiago
(74) *Attorney, Agent, or Firm* — Sughrue Mion, PLLC

(57) ABSTRACT

A spark plug including a center electrode and a ground electrode having a gap between the center electrode and the ground electrode, the ground electrode has an outer layer which is formed from an Ni-based alloy and a core portion which is covered by the outer layer and formed from a material having a thermal conductivity higher than that of the outer layer. Further, the melting point of the Ni-based alloy forming the outer layer is 1150° C. or more and 1350° C. or less.

5 Claims, 3 Drawing Sheets

(56) References Cited

FOREIGN PATENT DOCUMENTS

| | | | |
|---|---|---|---|
| JP | 2003217792 | A | 7/2003 |
| JP | 2004186152 | A | 7/2004 |
| JP | 2006-316344 | A | 11/2006 |
| JP | 2006316343 | A | 11/2006 |
| JP | 2007299670 | A | 11/2007 |
| JP | 2009016278 | A | 1/2009 |
| JP | 2009-94047 | A | 4/2009 |

OTHER PUBLICATIONS

International Search Report dated Mar. 22, 2011 issued in International Application No. PCT/JP2011/000078 (PCT/ISA/210).

Communication dated Sep. 16, 2013 from the State Intellectual Property Office of P.R. China in a counterpart application No. 201180007806.8.

* cited by examiner

SPARK PLUG

CROSS REFERENCE TO RELATED APPLICATIONS

This application is a National Stage of International Application No. PCT/JP 2011/000078 filed Jan. 11, 2011, claiming priority based on Japanese Patent Application No. 2010-239610 filed Oct. 26, 2010, the contents of all of which are incorporated herein by reference in their entirety.

TECHNICAL FIELD

The present invention relates to a spark plug, and particularly, to a spark plug including a core portion which is formed from materials having a high thermal conductivity in an inner portion of a ground electrode.

BACKGROUND ART

A spark plug is used for the ignition of an internal combustion engine such as an automobile engine. In general, the spark plug includes; a tubular metal shell; a tubular insulator which is disposed in an inner hole of the metal shell; a center electrode which is disposed in an inner hole of the leading end side of the insulator; and a ground electrode in which one end is bonded to the leading end side of the metal shell and the other end has a spark discharge gap between the ground electrode and the center electrode. In addition, the spark plug is spark-discharged at the spark discharge gap formed between the leading end of the center electrode and the leading end of the ground electrode in a combustion chamber of an internal combustion engine, and burns fuel filled in the combustion chamber.

However, in recent years, according to an output improvement by a supercharger, technology which lengthens the traveling distance that can be travelled using a small amount of fuel has been developed. In this kind of internal combustion engine, temperature within the combustion chamber tends to increase, and particularly, the temperature in the vicinity of an area, in which the leading end of the ground electrode is positioned, tends to be a high temperature. Moreover, according to miniaturization of the spark plug, the ground electrode has also become thin. Therefore, the ground electrode cannot conduct heat generated by the discharge of the spark plug to escape to the metal shell (also referred to as "heat conduction"). As a result, the temperature of the ground electrode itself is also easily increased.

The spark plug is used in a high temperature environment as described above, if the spark plug comes to have the configuration in which the temperature of the ground electrode is also easily increased, it is difficult to maintain a desired performance using the spark plug of the related art.

In Patent Document 1 having an object of providing a spark plug capable of decreasing a temperature increase of a ground electrode and of suppressing an anti-inflammatory action thereof, a spark plug is disclosed in which a core having higher thermal conductivity than that of the ground electrode is embedded in at least a portion other than a curved portion of the ground electrode.

RELATED ART DOCUMENTS

Patent Documents

[Patent Document 1] JP-A-2007-299670

SUMMARY OF INVENTION

Problem that the Invention is to Solve

In order to decrease the temperature increase of the ground electrode, when a configuration is adopted in which the outer layer of the ground electrode is formed form an Ni-based alloy and the core portion, which is covered by the outer layer and formed from Cu or the like having higher thermal conductivity than that of the outer layer, is installed, the following problems occur. That is, sliding is generated at the boundary surface between the core portion and the outer layer when the ground electrode is manufactured by difference of a processing degree due to the fact that materials forming the core portion and the outer layer are different from each other, and a gap is generated at the boundary surface between the core portion and the outer layer. As result, there are concerns that the heat conduction of the ground electrode may be deteriorated, the spark consumption resistance and the oxidation resistance may be decreased, and the electrode consumption may be increased. In addition, if the heat conduction of the ground electrode is deteriorated, temperature of the ground electrode is increased. Therefore, grains of the Ni-based alloy base material are grown, and there is a concern that the fracture strength of the ground electrode may be decreased.

An object of the invention is to provide a spark plug including a ground electrode capable of suppressing electrode consumption by adhering a core portion and an outer layer and maintaining a high thermal conductivity of the core portion and of suppressing grain growth of the Ni-based alloy base material in the ground electrode including the outer layer which is formed from the Ni-based alloy and the core portion which is covered by the outer layer and formed from material having higher thermal conductivity than that of the outer layer.

Means for Solving the Problem

In order to achieve the object of the invention, (1) there is provided a spark plug including: a center electrode, and a ground electrode having a gap between the center electrode and the ground electrode, wherein the ground electrode includes an outer layer which is formed from Ni-based alloy and a core portion which is covered by the outer layer and formed from material having higher thermal conductivity than that of the outer layer, and the melting point of the Ni-based alloy forming the outer layer is 1150° C. or more and 1350° C. or less.

In the spark plug (1), (2) the outer layer may include precipitates;

(3) the difference between a melting start temperature and a melting completion temperature of the outer layer may be 100° C. or more;

(4) the outer layer may include precipitates containing a eutectic structure; and (5) the outer layer may contain 96% by mass or more of Ni, 0.5% by mass or more and 1.5% by mass or less of Mn, and 0.5% by mass or more and 1.5% by mass or less of Si.

Advantageous Effects of Invention

The spark plug according to the invention includes the ground electrode including the outer layer which is formed from the Ni-based alloy and the core portion which is covered by the outer layer and formed from material having higher thermal conductivity than that of the outer layer, and annealing can be performed at an appropriate temperature when the ground electrode is manufactured due to the fact that the melting point of the Ni-based alloy forming the outer layer is 1150° C. or more and 1350° C. or less. Therefore, adherence of the boundary surface between the outer layer and the core portion can be enhanced, relative diffusion between elements contained in the outer layer and elements contained in the core portion is not excessively generated, and a high thermal conductivity of the core portion can be maintained. As a result, the ground electrode conducts heat received subject to the high temperature environment and heat generated due to discharge so as to be released to a metal shell, and so-called heat conduction is improved. Therefore, a spark consumption resistance and an oxidation resistance of the ground electrode are improved, and the electrode consumption can be suppressed. Moreover, since the heat conduction of the ground electrode is preferable even though the ground electrode is subject to a high temperature environment, grain growth of the Ni-based alloy base material can be suppressed, and fracture strength of the ground electrode can be maintained.

If the outer layer contains the precipitates, since the grain growth of the Ni-based alloy base material can be further suppressed, the fracture strength is prevented from decreasing.

If the temperature difference between the melting start temperature and the melting completion of the outer layer is 100° C. or more, the precipitates are evenly dispersed, the grain growth of the Ni-based alloy base material can be further suppressed, and the fracture strength can be maintained.

If the precipitates contain the eutectic structure, the temperature difference can be easily obtained, and the eutectic structure is laminar when the alloy forming the core portion and the outer layer is processed. Therefore, the precipitates can be easily crushed and dispersed. If the precipitates including the eutectic structure are dispersed in the outer layer, the grain growth of the Ni-based alloy can be further suppressed, an outer layer, in which defect such as void or crack hardly occurs, can be obtained. As a result, fracture strength can be maintained.

When annealing is performed in the course of forming the ground electrode even though the melting points of Mn and Si are easily adjusted to the range, diffusion speed of Mn and Si into the core portion formed from Cu or the like is great, and the thermal conductivity of the core portion can be easily decreased. However, if the outer layer contains 0.5% by mass or more and 1.5% by mass or less of Mn and 0.5% by mass or more and 1.5% by mass or less of Si, Mn and Si are prevented from excessively dispersing into the core portion formed from Cu or the like, and the thermal conductivity of the core portion can be prevented from decreasing.

BRIEF DESCRIPTION OF DRAWINGS

FIG. 2(*b*) is an explanatory view schematically showing one other example of results in which a differential thermal analysis of the Ni-based alloy forming the outer layer is performed.

DESCRIPTION OF EMBODIMENTS

A spark plug according to the invention includes a center electrode and a ground electrode, and one end of the center electrode and one end of the ground electrode are disposed so as to be opposite to each other via a gap. The ground electrode includes at least a core portion and an outer layer housing the core portion, and the core portion is formed from a material having higher thermal conductivity than that of the outer layer. The spark plug according to the invention can adopt various known configurations without specifically limiting other configurations as long as the spark plug has the above-described configuration.

Figure 1:
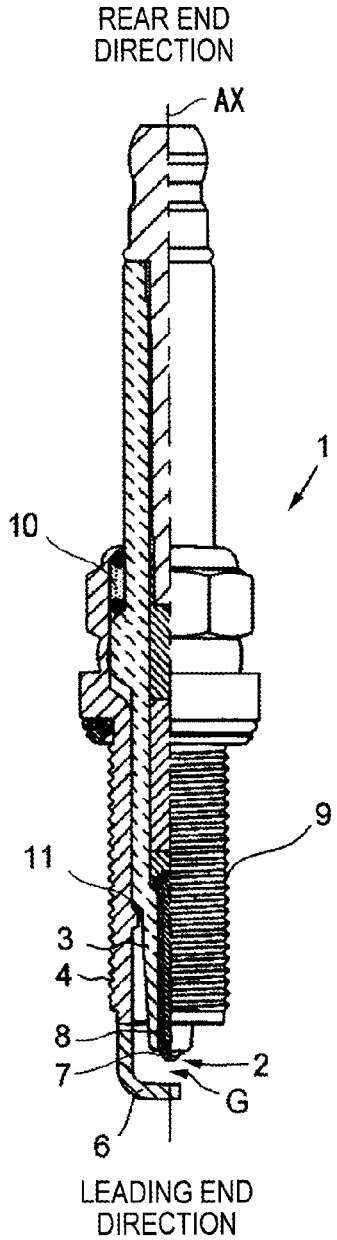
FIG. 1 is an explanatory view for explaining a spark plug which is an embodiment of a spark plug according to the invention, FIG. 1(*a*) is an entire explanatory view in which the spark plug of an embodiment of the spark plug according to the invention is shown in a partial cross-section, and FIG. 1(*b*) is an explanatory view in which a main portion of the spark plug of an embodiment of the spark plug according to the invention is shown in a cross-section.
Figure 1:
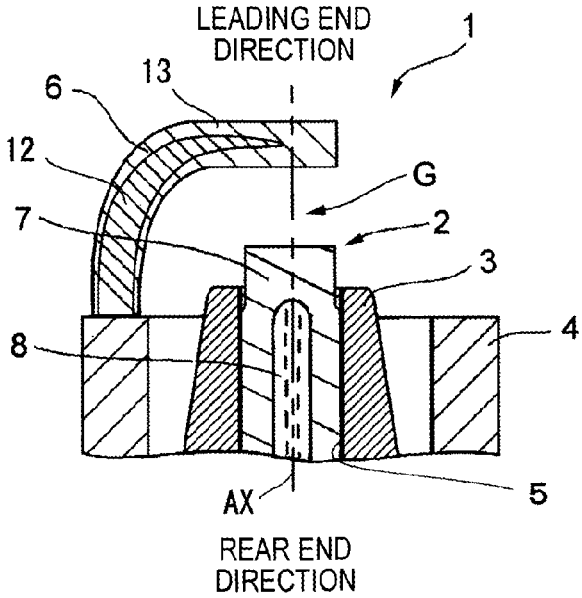

FIG. 1 shows a spark plug which is an embodiment of the spark plug according to the invention. FIG. 1(*a*) is an entire explanatory view in which the spark plug 1 of an embodiment of the spark plug according to the invention is shown in a partial cross-section, and FIG. 1(*b*) is an explanatory view in which a main portion of the spark plug 1 of an embodiment of the spark plug according to the invention is shown in a cross-section. In addition, in FIG. 1(*a*), the downward surface of the paper is given as a leading end direction of an axis line AX and the upward surface of the paper is given as a rear end direction of the axis line AX. In FIG. 1(*b*), the upward surface of the paper is given as a leading end direction of the axis line AX and the downward surface of the paper is given as a rear end direction of the axis line AX.

As shown in FIGS. 1(*a*) and 1(*b*), the spark plug 1 includes: a center electrode 2 which is formed in an approximate bar-shape; an approximately tubular insulator 3 that is installed in the outer periphery of the center electrode 2; a tubular metal shell 4 that holds the insulator 3; and a ground electrode 6 in which one end is disposed to be opposite to the leading end surface of the center electrode 2 via a spark discharge gap G and the other end is bonded to the end surface of the metal shell 4.

The metal shell 4 is tubular and formed so as to hold the insulator 3 by housing the insulator 3. A screw portion 9 is formed at the outer periphery surface in the leading end direction of the metal shell 4, and the spark plug 1 is mounted to a cylinder head of an internal combustion engine (not shown) by using the screw portion 9. The metal shell 4 may be formed from a conductive ferrous material, for example, by low-carbon steel.

The insulator 3 is held to the inner periphery of the metal shell 4 via a talc 10 or a packing 11 and the like, and the insulator 3 includes a shaft hole 5 holding the center electrode 2 along the direction of the axis line of the insulator 3. The insulator 3 is fixed to the metal shell 4 in a state where the tip in the leading end direction of the insulator 3 is protruded from the leading end surface of the metal shell 4. It is preferable that material of the insulator 3 is material having a mechanical strength, a thermal strength, and an electric strength, for example, the material may be sintered ceramic consisting mainly of alumina.

The center electrode 2 includes an outer member 7 and an inner member 8 which are formed so as to be concentrically embedded in the axial center portion of the inner portion of the outer member 7. The center electrode 2 is fixed to the shaft hole 5 of the insulator 3 in a state where the leading end portion 6 of the center electrode is protruded from the leading end surface of the insulator 3, and is held so as to be insulated with respect to the metal shell 4. The inner member 8 is preferably formed from material having higher thermal conductivity than that of the outer member 7, and the material of the inner member may be, for example, Cu, Cu alloy, Ag, Ag alloy, pure Ni, or the like. The outer member 7 may be formed from electrode material used in an outer layer 13 of the ground electrode 6 described hereinafter or any known material other than the electrode material.

The ground electrode 6 is formed, for example, in an approximately rectangular column. In addition, one end of the ground electrode 6 is bonded to the end surface of the metal shell 4, and the ground electrode is bent in an approximate L-shape at the intermediate portion. The shape and the configuration of the leading end portion of the ground electrode are designed so as to be disposed in the direction of the axis line of the center electrode 2. Due to the fact that the ground electrode 6 is designed as described above, one end of the ground electrode 6 is disposed to be opposite to the center electrode 2 via the spark discharge gap G. The spark discharge gap G is a gap formed between the leading end surface of the center electrode 2 and the surface of the ground electrode 6, and in general, the spark discharge gap G is set to 0.3 mm to 1.5 mm.

The ground electrode 6 includes a core portion 12 which is installed in the axial center portion of the ground electrode 6, and an outer layer 13 which houses the core portion 12. Next, the outer layer 13 will be described below. The outer layer 13 is formed from electrode material referred to as the Ni-based alloy, and the core portion 12 is formed from material having higher thermal conductivity than that of the outer layer 13. For example, material forming the core portion 12 includes metal such as Cu, Cu alloy, Ag, Ag alloy, and pure Ni. Among the above-described, in terms of workability or cost, it is preferable that the core portion 12 is formed from Cu or Cu alloy.

The melting point of material forming the outer layer 13 is 1150° C. or more and 1350° C. or less. When the melting point of the outer layer 13 is within the range, if annealing is performed in the process for manufacturing the ground electrode 6, sliding, which is generated at the boundary surface between materials of outer layer 13 and the core portion 12 by difference of a processing degree due to difference of both materials, can be suppressed. Therefore, not only is a gap not easily generated at the boundary surface, but also the adhesion between the core portion 12 and the outer layer 13 is improved due to the fact that a relative diffusion is generated at the boundary surface between the core portion 12 and the outer layer 13. In general, since the annealing temperature of material is ⅓ or more of the melting point of the material, the annealing temperature of the outer layer 13 is also decreased if the melting point is decreased, and an appropriate relative diffusion capable of maintaining the adhesion of the outer layer 13 without having an excessively relative diffusion is performed. Thereby, the core portion 12, particularly a high thermal conductivity of the core portion 12 formed from Cu can be maintained. As a result, the heat conduction of the ground electrode 6 is improved, the consumption resistance and the oxidation resistance are also improved, and the electrode consumption can be suppressed. In addition, even though the ground electrode 6 is subjected to a high temperature environment, grain growth of Ni-based alloy base material is suppressed due to the improved heat conduction, and therefore, the fracture strength can be maintained.

If the melting point of the outer layer 13 is 1150° C. or less, since the spark consumption resistance is decreased, the electrode consumption is increased and the ground electrode 6 itself becomes thin. This means that heat-dissipation paths become small, as a result, the temperature of the ground electrode 6 itself is increased. When a spark plug including the ground electrode 6 formed in this way is actually used, the grain of the Ni-based alloy base material is easily grown for the above-described reasons. In addition, as a result, the fracture strength is decreased.

If the melting point of the outer layer 13 exceeds 1350° C., since the annealing temperature is also increased, an excessive diffusion is generated between Ni-based alloy forming the outer layer 13 and the material forming the core portion 12, for example, Cu or the like, and the thermal conductivity of the core portion 12 is decreased. Thereby, the heat conduction of the ground electrode 6 is deteriorated, the spark consumption and the oxidation resistance are deteriorated, and the electrode consumption is increased. In addition, the heat conduction of the ground electrode 6 is deteriorated, the temperature of the ground electrode 6 is increased and the grain of the Ni-based alloy base material is easily grown, and the fracture strength is decreased.

Average grain diameter of the crystal grain of the Ni-based alloy base material is preferably less than 200 μm, more preferably less than 150 μm, and particularly preferably less than 100 μm. If the average grain diameter of the crystal grain of the Ni-based alloy base material is less than 200 μm, the facture strength needed to the ground electrode 6 can be maintained.

The outer layer 13 preferably contains precipitates. If the outer layer 13 contains precipitates, even though the ground electrode 6 is disposed in the combustion chamber of a high temperature environment and is subjected to the environment in which the grain of the Ni-based alloy base material is easily grown, the precipitates are present between the crystal grains, that is, at the grain boundary. Therefore, the grain growth in the crystal grain of the Ni-based alloy base material can be suppressed, and the fracture strength can be maintained. The precipitates are materials which are precipitated and formed in the boundary of the crystal grain from the Ni-based alloy in the course of melting the Ni-based alloy forming the outer layer 13. The precipitates include an oxide of the element contained to the Ni-based alloy, an intermetallic compound to the element contained to Ni and the Ni-based alloy, an intermetallic compound between the elements contained to the Ni-based alloy, and eutectic structures of the intermetallic compound and the metal oxide, or the like. The elements contained in the Ni-based alloy include Al, B, 2A group elements, 3A group elements, and 4A group elements. The precipitates which are oxides include an oxide of at least one kind selected from the group consisting of those elements.

It is preferable that the precipitates are evenly dispersed in the entire outer layer 13. If the precipitates are evenly dispersed, even though the ground electrode 6 is disposed in the combustion chamber of a high temperature environment and is subjected to the environment in which the grain of the Ni-based alloy base material is easily grown, the grain growth of the Ni-based alloy base material can be further suppressed due to the fact that the precipitates are evenly dispersed at the grain boundary of the Ni-based alloy base material.

It is preferable that the precipitates include the eutectic structure. If the precipitates have the eutectic structure, after a bar-shaped body of Cu or the like forming the core portion 12 is inserted into the a cup body formed in a cup shape from the Ni-based alloy, in the course of processing and deforming this and forming the ground electrode 6, the eutectic structure, which is crystallized when the Ni-based alloy is molten and solidified, is crushed by the processing stress. Therefore, the grains of the precipitates having the eutectic structure are small, and the precipitates are easily and evenly dispersed. Since the eutectic structure is easily crushed when the ground electrode 6 is processed if the precipitates have the eutectic structure, defects such as voids or cracks in the grain boundary of the Ni-based alloy base material are not easily generated, and the fracture strength can be maintained. Therefore, it is preferable that the precipitates including the eutectic structure are dispersed in the outer layer 13.

The average grain diameter of the precipitates is preferably 0.05 μm or more and 10 μm or less, more preferably 0.05 μm or more and 5 μm or less. If the average grain diameter of the precipitates is within the range, the precipitates can be easily evenly dispersed and the grain growth of the Ni-based alloy base material can be suppressed. Therefore, the fracture strength can be maintained. In addition, the processing defect of the base material itself in the processing of the Ni-based alloy is not easily generated.

The formation and the dispersion state of the precipitates can be identified by a metallurgical microscope or an electron microscope (for example, SEM). The average grain diameter of the precipitates can be obtained by measuring the short diameter and the long diameter with respect to arbitrary 50 precipitates which are present in a visual field when observing the precipitates by the above-described devices or the like and calculating the arithmetical mean of all the measured values. The dispersion state of the precipitates can also be observed by the above-described devices, and the precipitates can be determined to be dispersed if the grains of the respective precipitates are separated without having uneven distribution or aggregation. In addition, by methods similar to the average grain diameter of the precipitates, the average grain diameter of the crystal grain of the Ni-based alloy base material can be obtained.

The shapes of the precipitates can be confirmed as to whether or not the precipitates have the eutectic structure through observation of an electron microscope. Moreover, the compounds forming the precipitates can be specified by classification through X-ray or a quantitative device which is auxiliary to the electron microscope.

It is preferable that temperature difference between the melting start temperature and the melting completion temperature of the outer layer 13 is 100° C. or more and 200° C. or less. If the temperature difference between the melting start temperature and the melting completion temperature of the outer layer 13 is 100° C. or more, the outer layer 13 in which the precipitates are evenly dispersed can easily be obtained. As a result, the grain growth of the Ni-based alloy base material can be suppressed, and the fracture strength can be maintained. In addition, if the temperature difference is 200° C. or less, there is no concern that the composition of the Ni-based alloy base material is partially different by solidification segregation.

Figure 2:
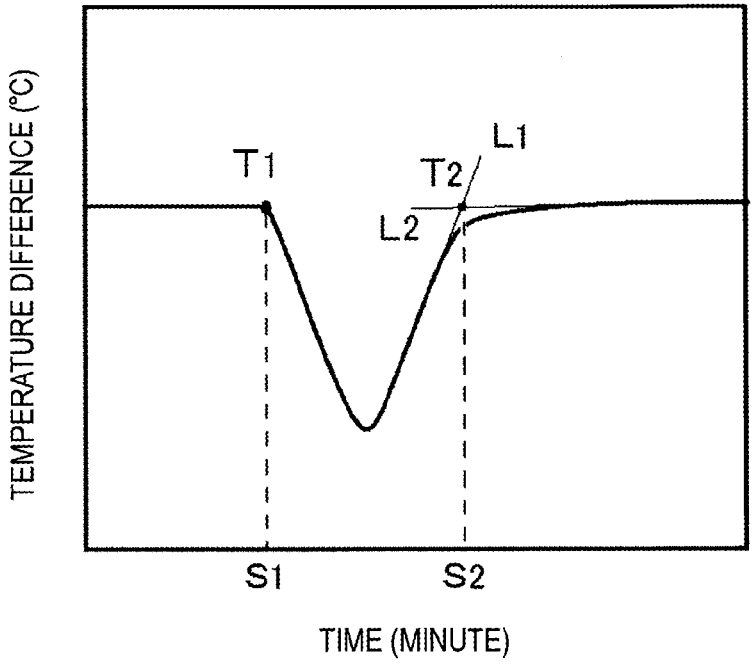
FIG. 2(*a*) is an explanatory view schematically showing an example of results in which a differential thermal analysis of Ni-based alloy forming an outer layer is performed.
Figure 2:
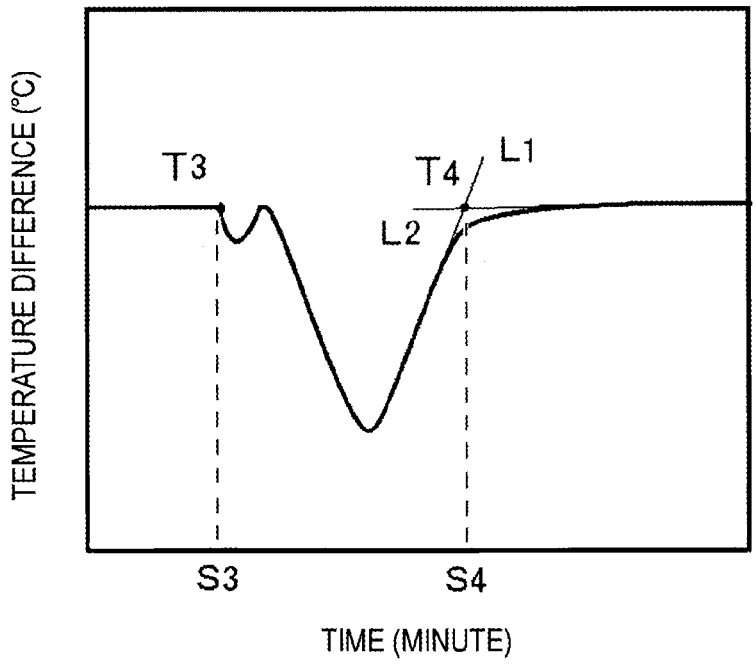

The melting start temperature and the melting completion temperature of the outer layer 13 can be measured by a difference thermal analysis (DTA). FIG. 2(*a*) is an explanatory view schematically showing an example of results in which the differential thermal analysis of the Ni-based alloy forming the outer layer is performed. In the difference thermal analysis, for example, a portion of the outer layer 13 is extracted as a sample, the sample is carried on the difference thermal analysis device along with a reference material, the sample and the reference material are subjected to a high temperature, and the temperature difference between the sample and the reference material is measured. As shown in FIG. 2(*a*), the longitudinal axis is given as the temperature difference between the sample and the reference material, the horizontal axis is given as time, thus, a DTA curve is obtained. As the temperature of the sample and the reference material is increased, an endothermic change of the DTA curve appears. That is, the DTA curve plotting a base line is drastically changed downwardly for a predetermined time, and plots a convex endothermic curve downward. In addition, if a predetermined time elapses, the DTA curve again plots the trajectory of the base line. The temperature of the sample when the endothermic change starts is the melting start temperature $T_1$, and the temperature of the sample when the endothermic change ends and returns to the base line is the melting completion temperature $T_2$. When the base line is not constant, for example, the base line plots the curve such as a peak, and the melting start temperature and the melting completion temperature are not clearly determined, correction of the base line is performed. For example, as shown in FIG. 2(*a*), when the end point of the endothermic change is not clear, tangential lines $L_1$ and $L_2$ regarding the endothermic curves before and after when the endothermic change ends and the base line respectively are drawn, the temperature of the sample in the time $S_2$ which cross the tangential lines $L_1$ and $L_2$ is given as the melting completion temperature $T_2$.

As shown in FIG. 2(*b*), if the difference thermal analysis of the Ni-based alloy forming the outer layer 13 is performed, there is a case where the DTA curve represents two endothermic changes. At this time, in an endothermic change having a small temperature difference which initially appears after the temperature rise starts, the temperature of the sample when the endothermic change starts is given as the melting start temperature $T_3$. In addition, in an endothermic change having a great temperature difference, the temperature of the sample when the endothermic change ends and returns to the base line is given as the melting completion temperature $T_4$.

The melting point of the outer layer 13 can be measured by the difference thermal analysis, as shown in FIG. 2(*a*), in the case of one endothermic changes, the melting point is the temperature $T_1$ of the sample when the endothermic change starts. As shown in FIG. 2(*b*), in the case of two endothermic changes, the melting point is the temperature $T_3$ of the sample at the time of starting the endothermic change having a small temperature difference which initially appears after the temperature rising starts.

It is preferable that the outer layer 13 contains 96% by mass or more of Ni, 0.5% by mass or more and 1.5% by mass or less of Mn, and 0.5% by mass or more and 1.5% by mass or less of Si.

Since Ni has a high thermal conductivity, Ni has the effect which causes the heat conduction of the ground electrode 6 to be improved. If Mn, Si, Al, Cr, or the like is contained in the outer layer along with Ni, the oxidation resistance of the outer layer can be improved. However, the amount of those elements is too much, when annealing is performed in the course of forming the ground electrode 6, those elements are excessively dispersed to the material forming the core portion 12, for example, Cu. Therefore, since there is a concern that the thermal conductivity of the core portion 12 is decreased, it is preferable that the content of Ni is 96% by mass or more.

Even though Mn and Si are elements which easily regulate the melting point of the outer layer 13 to 1150° C. or more and 1350° C. or less, Mn and Si are rapidly dispersed into Cu and decrease the thermal conductivity of the core portion 12 formed by Cu or the like as described above. Accordingly, if Mn and Si are contained within the range, when the annealing is performed in the course of forming the ground electrode 6, Mn and Si are not excessively dispersed into the core portion 12 formed by Cu or the like. Therefore, it is preferable that the Mn and Si are contained within the range.

Other than the metal elements described above, if necessary, the outer layer 13 can contain at least one kind selected from 2A group elements such as Mg, Ca and Sr, 3A group elements such as Sc, Y and rare earth elements, 4A group elements such as Ti, Zr and Hf, Al, Cr, Au, B, or the like.

The total contents of the 2A group elements, 3A group elements, 4A group elements, Al, and B in the outer layer 13 is preferably 3% by mass or less, and more particularly is 2% by mass or less. If the total content of the above elements is within the range, excessive precipitates are not generated, and workability is not deteriorated.

The rare earth elements may include Nd, La, Ce, Dy, Er, Yb, Pr, Pm, Sm, Eu, Gd, Tb, Ho, Tm, Lu.

It is preferable that the content of Au in the outer layer 13 is 10% by mass or more and 28% by mass or less. If the content of Au is within the range, due to the fact that the material forming the outer layer 13 is within the melting range specified according to the invention, the occurrence of oxidation of Au itself is not generated and the oxidation resistance of the outer layer is improved.

It is preferable that total content of Cr and/or Al in the outer layer 13 is 0.05% by mass or more and 0.8% by mass or less. If the total content of Cr and/or Al is within the range, the thermal conductivity of the Ni-based alloy is not decreased, and the oxidation resistance can be improved.

The outer layer 13 contains Ni, Mn, and Si, and if necessary, substantially contains at least one kind selected from a group consisting of 2A group elements, 3A group elements, 4A group elements, Al, Cr, Au, and/or B. Within the ranges of contents of each component described above, each component is contained so that the total of every component and inevitable impurities is 100% by mass. Components other than the components, for example, Fe, Cu, P, S, and C may be contained as a minute amount of inevitable impurities. It is preferable that the contents of the inevitable impurities are contained in a small amount. However, the inevitable impurities may be contained within the range which can achieve the object of the invention. In addition, when the total mass of components described above is given as 100 parts by mass, the ratio of the above-described one kind of inevitable impurities may be 0.1 parts by mass or less, and the total ratio of all the kinds of inevitable impurities contained may be 0.2 parts by mass or less.

The contents of each component contained in the outer layer 13 can be measured as follows. That is, a predetermined amount of the sample is extracted from the outer layer 13, and mass analysis of the sample is performed by an ICP emission spectrometry (Inductively Coupled Plasma emission spectrometry). Ni is calculated from the remainder of the analyzed measurement values. In the ICP emission spectrometry, the dissolution of the sample is performed through an acid digestion by using nitric acid or the like, and, after the qualitative analysis of the sample is performed, the quantity with respect to the detected element and the designated element is determined (for example, iCAP-6500 manufactured by THERMO FISHER may be used as the ICP emission spectrometry device). The average value of the values measured 3 times is calculated, and the average value is given as the content of each component in the outer layer 13.

In addition, predetermined raw materials are blended by predetermined blend ratios, and the outer layer 13 is made as described below.

For example, the spark plug 1 is made as follows. First, the manufacturing method of the ground electrode 6 will be described. Pure Ni having a desired composition and other metallic elements are melted and regulated, and the regulated Ni-based alloy is processed in a cup shape and manufactured as a cup body to be the outer layer 13. On the other hand, material such as Cu having higher thermal conductivity than that of the outer layer 13 is melted, and manufactured as a bar-shaped body to be the core portion 12 by performing a hot working, a drawing process, or the like. The bar-shaped body is inserted into the cup body, and preferably, after annealing is performed in the range of 400° C. or more to 1000° C. or less, is plastically processed to a desired shape by performing plastic processing such as extruding processing. In this way, the ground electrode 6 having the core portion 12 in the inner portion of the outer layer 13 is manufactured.

Due to the fact that the annealing is performed in the above process, workability is improved, and the gap of the boundary surface between the outer layer 13 and the core portion 12 can be made small. In addition, since the annealing is performed in the temperature range, adherence between the core portion 12 and the outer layer 13 can be improved, and excessive diffusion between them is not generated. Therefore, high thermal conductivity of the core portion 12 can be maintained. As a result, since the heat conduction of the ground electrode 6 is improved and the consumption resistance and the oxidation resistance are improved, the electrode consumption can be suppressed. In addition, since the annealing is performed in the temperature range, even though the ground electrode 6 is subject to a high temperature environment, the grain growth of the Ni-based alloy base material can be suppressed due to the improved heat conduction, and the fracture strength can be maintained.

In addition, in the above-described manufacturing method of the ground electrode 6, when pure Ni and other metallic elements are melted, if oxide powders of Al, B, 2A group elements, 3A group elements and/or 4A group elements are also added, since those oxide powders are present without being resolved even reaching the melting temperatures due to the fact that those metallic oxide powders are stable, those metallic oxide powders can be contained in the outer layer 13 as precipitates.

As another method for forming the precipitates, the following method is used. In the above-described manufacturing method of the ground electrode 6, when pure Ni and other metallic elements are melted, an internal oxidation can be generated by a preferred oxidation treatment of the following added elements with respect to wire rods of an intermediate processing or ingots of the later pigs which are formed after Al, B, 2A group elements, 3A group elements, and/or 4A group elements are added to the pure Ni as the metallic elements, melted, and homogenized. By the preferred oxidation treatment, the oxides of Al, B, 2A group elements, 3A group elements, and/or 4A group elements are contained in the outer layer 13 as precipitates. In addition, the preferred oxidation treatment is performed through a heating processing in a hypoxic atmosphere in which at least Ni is not oxidized. If the heating processing is performed in the oxygen concentration of an oxidization dissociation pressure or more of a desired element, it is preferable as the oxidization of the other elements is not accompanied. The preferred oxidation treatment includes performing the heat-processing in a hydrogen-water vapor atmosphere.

As another method for forming the precipitates, the following method is used. In the above-described manufacturing method of the ground electrode 6, when pure Ni and other metallic elements are melted, Al, B, 2A group elements, 3A group elements, and/or 4A group elements are added to the pure Ni as the metallic elements. At this time, those elements are added in the amount which can generate intermetallic compounds between those elements or between those elements and Ni. Thereby, the intermetallic compounds and/or eutectic structures including the intermetallic compounds can be formed when the molten metal is solidified According to the similar method to that of the ground electrode 6 described above, the center electrode 2 can be manufactured by using material having the same composition as that of the outer layer 13 or the known materials. In a case where the center electrode 2 is not provided with the inner member 8 formed by material having a high thermal conductivity in the inner portion, the center electrode 2 can be manufactured as follows. That is, molten metal of an alloy having a predetermined composition is prepared, after an ingot is prepared from the molten metal, the ingot is appropriately regulated to a predetermined shape and a predetermined size by hot working, a drawing process, or the like, thus, the center electrode 2 is manufactured.

Subsequently, one end of the ground electrode 6 is bonded to the end surface of the metal shell 4, which is formed to a predetermined shape by plastic processing or the like, by electric resistance welding or laser welding or the like. Subsequently, Zn coating or Ni coating is applied to the metal shell 4 to which the ground electrode 6 is bonded. After the Zn coating and the Ni coating is performed, a trivalent chromate treatment may be performed. In addition, coating may be applied to the ground electrode 6, masking may be applied so that the coating is not attached to the ground electrode 6, and the coating attached to the ground electrode 6 may be separately peeled. Subsequently, the insulator 3 is manufactured by firing ceramic or the like to a predetermined shape, the center electrode 2 is assembled to the insulator 3 by known methods, and the insulator 3 is assembled to the metal shell 4 to which the ground electrode 6 is bonded. In addition, the leading end portion of the ground electrode 6 is bent to the center electrode 2 side, and the spark plug 1 is manufactured so that one end of the ground electrode 6 is opposite to the leading end portion of the center electrode 2.

The spark plug according to the invention is used for ignition of an internal combustion engine for an automobile, for example, a gasoline engine or the like. That is, the screw portion 9 is screwed to a screw hole which is installed in a head (not shown) partitioning the combustion chamber of the internal combustion engine, and the spark plug is fixed to a predetermined position. The spark plug according to the invention can be used in any internal combustion engine. However, since the spark plug includes the ground electrode 6 capable of suppressing the electrode consumption even in a high temperature environment and maintaining the fracture strength, particularly, the spark plug can be appropriately used in an internal combustion engine in which the temperature in the combustion chamber is higher than that of the combustion chamber of the related art.

Figure 3:
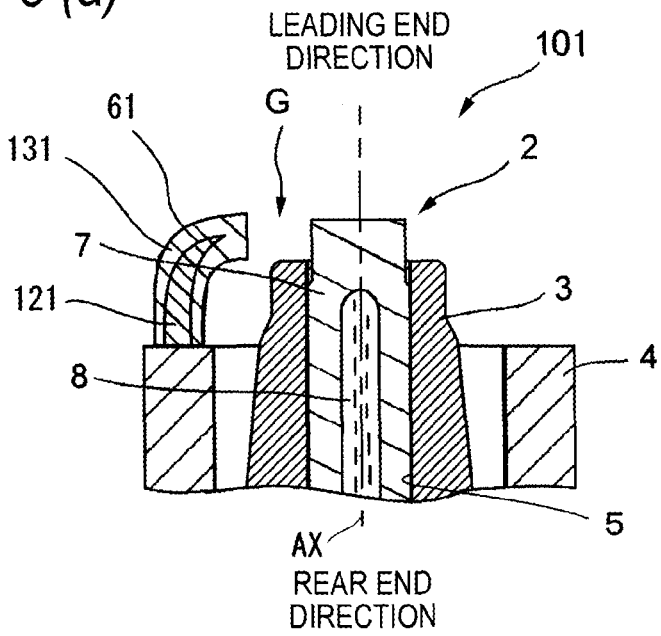
FIG. 3(*a*) is an explanatory view in which a main portion of a spark plug of another embodiment of a spark plug according to the invention is shown in a cross-section, and FIG. 3(*b*) is an explanatory view in which a main portion of a spark plug of still another embodiment of a spark plug according to the invention is shown in a cross-section.
Figure 3:
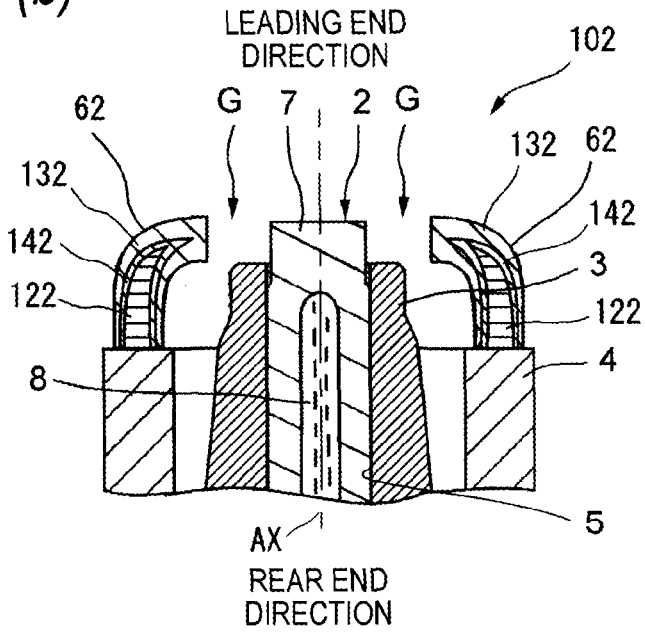

In addition, the spark plug 1 according to the invention is not limited to the above-described embodiment, and various modifications can be performed within the range which can achieve the object of the invention. For example, in the above-described spark plug 1, the leading end surface of the center electrode 2 and the surface of one end of the ground electrode 6 are disposed so as to be opposite to each other in the direction of the axis line AX via the spark discharge gap G. However, in the invention, as shown in FIG. 3, the side surface of the center electrode 2 and the leading end surfaces of the one ends of ground electrodes 61, 62 may be disposed so as to be opposite to each other in the radial direction of the center electrode 2 via the spark discharge gap G. In this case, the ground electrodes 61 and 62 opposite to the side surface of the center electrode 2 may be installed singly as shown in FIG. 3(*a*), and may be installed in a plurality as shown in FIG. 3(*b*).

In the spark plug 1, as shown in FIG. 1(*b*), the ground electrode 6 is formed by the core portion 12 and the outer layer 13 housing the core portion 12. However, as shown in FIG. 3(*b*), the ground electrode 62 may be formed by a core portion 122, an outer layer 132 housing the core portion 122, and an intermediate layer 142 which is installed between the core portion 122 and the outer layer 132 so as to cover the core portion 122. For example, the outer layer 132 may be formed from the electrode material, the intermediate layer 142 may be formed from a metallic material having Cu as the main component, and the core portion 122 may be formed from pure Ni. In the ground electrode 62 having the configuration such as this, the heat conduction is excellent, and the temperature of the ground electrode 62 subjected to a high temperature can be effectively decreased. In addition, if the core portion 12 is formed from pure Ni, deformation of the ground electrode 62 can be prevented. Therefore, when the spark plug is mounted on the internal combustion engine, the ground electrode 62 can be prevented from being erected.

In addition, the spark plug 1 includes the center electrode 2 and the ground electrode 6. However, in the invention, both or either of the leading end portion of the center electrode 2 and the surface of the ground electrode 6 may have a noble metal tip. The noble metal tip, which is formed at the leading end portion of the center electrode 2 and the surface of the ground electrode 6, generally has a circular column or a quadrilateral column, and is regulated to a suitable size. Thereafter, the noble metal tip is melted and fixed to the leading end portion of the center electrode 2 and the surface of the ground electrode 6 by a suitable welding method, for example, by laser welding or electrode resistance welding. In this case, a gap formed between two surfaces of two noble metal tips which face each other, or a gap between the surface of the noble metal tip and the surface of the center electrode 2 or the ground electrode 6 which is opposite to the noble metal tip serves as the spark discharge gap. For example, the material forming the noble metal tip may be noble metals such as Pt, a Pt alloy, Ir, an Ir alloy, or the like.

Embodiment

Manufacture of Ground Electrode

By using a normal vacuum melting furnace, molten metal of an alloy having the compositions shown in Table 1 was prepared, and ingots from each molten metal were prepared by vacuum casting. Thereafter, the ingots were made into round bars by hot casting, and a cup-shaped body as the outer layer was manufactured by forming the round bar into a cup shape. On the other hand, Cu or Cu alloy was made into a round bar by hot casting, and a bar-shaped body as the core portion was manufactured by performing hot working, a drawing process, or the like with respect to the round bar. The bar-shaped body was inserted into the cup-shaped body, by performing a drawing process after performing plastic processing such as an extruding process, and the ground electrode was manufactured. In addition, in the above process, since the ground electrode was manufactured without performing annealing, the obtained ground electrode is referred to as a ground electrode without annealing hereinafter.

Moreover, Cu alloy in which Cu was 99% by mass and the total amount of Al, Cr, Si, and Zr was 1% by mass was used in Examples 5, 14, and 27, and pure Cu having 100% by mass of Cu was used in the other examples and comparative examples.

In addition, after the bar-shaped body was inserted into the cup body in the manufacture of the above-described ground electrode without the annealing, except heating and maintaining in a vacuum of 700° C. for 1 hour and annealing, a ground electrode was manufactured similarly to the ground electrode without the annealing. Since this ground electrode was manufactured by performing the annealing, the ground electrode is referred to as a "ground electrode with annealing".

Manufacture of Spark Plug Sample

By known methods, an end of the ground electrode with annealing was bonded to one end surface of the metal shell. Subsequently, the center electrode was assembled to the insulator formed by ceramics, and the insulator was assembled to the metal shell to which the ground electrode with annealing was bonded. Moreover, the leading end portion of the ground electrode with annealing was bent to the center electrode side and the sample of the spark plug was manufactured so that the leading end surface of the ground electrode was opposite to the side surface of the center electrode.

In addition, the diameter of the screw of the sample of the manufactured spark plug was M14 and the spark discharge gap between the leading end surface of the ground electrode and the side surface of the center electrode which faces the ground electrode was 1.1 mm.

Measurement Methods of Melting Point, Melting Start Temperature, and Melting Completion Temperature As describe above, samples were extracted from the outer layer in the ground electrode, subjected to the difference thermal analysis, and the DTA curve was obtained. The temperature of the sample when the endothermic change started was given as the melting point and the melting start temperature, and the temperature of the sample when the endothermic change ended was given as the melting completion temperature.

Observation of Precipitates

The surface of the manufactured ground electrode was observed by the SEM, and it was observed whether or not the precipitates were present and the shapes of the precipitates were observed. The classification of the precipitates was performed by a quantitative device which is auxiliary to the EPMA.

Composition

The composition of the outer layer of the manufactured ground electrode was analyzed by ICP emission spectrometry (iCAP-6500 manufactured by THERMO FISHER).

Estimation Method

Workability

With respect to the ground electrode without annealing and the ground electrode with annealing which were manufactured as described above, the maximum distances of gaps of boundary surfaces between the outer layers and the core portions in the cross-sections obtained by cutting along the longitudinal directions of the ground electrodes, and the maximum diameters of voids (bubbles) in the outer layers were measured. Those measured values were estimated based on the following references. The results are shown in Table 2.

X: the maximum distances of the gaps or the maximum diameters of the voids were 200 μm or more, or the electrodes could not be processed to the shape of the ground electrode.

○: The maximum distances between the gaps or the maximum diameters of the voids were 100 μm or more and less than 200 μm.

◎: The maximum distances between the gaps or the maximum diameters of the voids were 50 μm or more and less than 100 μm.

◆: The maximum distances between the gaps or the maximum diameters of the voids were less than 50 μm.

Electrode Consumption

The sample of the spark plug manufactured as described above was mounted on a gasoline engine of 2000 cc. Thereafter, in a full throttle open state, an endurance test maintaining a state of the engine at 5000 rpm for 300 hours was performed. The sample of the spark plug was removed from the engine after the test, and was cut along the longitudinal direction of the ground electrode from the center of the leading end portion in the ground electrode. Thereafter, the consumption thickness in the portion of 1 mm from the leading end of the ground electrode in the obtained cutting cross-section was measured. The electrode consumption thicknesses were estimated based on the following references. The results are shown in Table 2.

X: The electrode consumption thicknesses were 100 μm or more.

○: The electrode consumption thicknesses were 80 μm or more and less than 100 μm.

◎: The electrode consumption thicknesses were 50 μm or more and less than 80 μm.

◆: The electrode consumption thicknesses were 50 μm or less.

Grain Growth of Ni-Based Alloy Base Material

After performing the endurance test of the sample of the spark plug in the above-described electrode consumption estimation, the cross-section was observed similarly to the estimation, and the average grain diameters of the metals were measured by a metallurgical microscope. The average grain diameters of the metals were obtained by measuring the short diameters and the long diameters with respect to grains of arbitrary 50 metals which were presented in a view when the metals were observed by the metallurgical microscope, and by calculating the arithmetical means of all measured values. Growth degrees of the grains of the N-based alloy material were estimated by the obtained average grain diameters based on the following references. The results are shown in Table 2.

X: The average grain diameters were 200 μm or more.

○: The average grain diameters were 150 μm or more and less than 200 μm.

◎: The average grain diameters were 100 μm or more and less than 150 μm.

◆: The average grain diameters were 70 μm or more and less than 100 μm.

◆◆: The average grain diameters were less than 70 μm.

Comprehensive estimations in Table 2 were estimated based on the following references. In each estimation, X was denoted if the number of X is 1 or more, ◎ was denoted if the number of ◎ (or more) is 2 or more, and ◆ was denoted if the number of ◆ was 3 or more.

TABLE 1

| No. | | Melting Point (Melting Start Temperature $T_1$) (° C.) | Composition (% by mass) Ni | Si | Mn | Au | Nd | Zr | Y | Ce | Al, Cr, etc. | Whether or not Precipitates were Present | Melting Completion Temperature $T_2$) (° C.) | Temperature Difference $T_2 - T_1$ (° C.) | Precipitates Shapes |
|---|---|---|---|---|---|---|---|---|---|---|---|---|---|---|---|
| 1 | Comparative Example | 1360 | 91.1 | | 8.9 | | | | | | | Not Present | 1393 | 33 | |

TABLE 1-continued

| No. | | Melting Point (Melting Start Temperature $T_1$) (° C.) | Composition (% by mass) Ni | Si | Mn | Au | Nd | Zr | Y | Ce | Al, Cr, etc. | Whether or not Precipitates were Present | Melting Completion Temperature $T_2$) (° C.) | Temperature Difference $T_2 - T_1$ (° C.) | Precipitates Shapes |
|---|---|---|---|---|---|---|---|---|---|---|---|---|---|---|---|
| 2 | Comparative Example | 1367 | 92.0 | | | 8.0 | | | | | | Not Present | 1440 | 73 | |
| 3 | Example | 1350 | 90.0 | | 10.0 | | | | | | | Not Present | 1380 | 30 | |
| 4 | Example | 1326 | | | | 10.0 | | | | | | Not Present | 1418 | 92 | |
| 5 | Example | 1320 | 89.0 | | | 11.0 | | | | | | Not Present | 1420 | 100 | |
| 6 | Example | 1285 | 84.1 | | 15.9 | | | | | | | Not Present | 1330 | 45 | |
| 7 | Example | 1210 | 78.6 | | | 21.4 | | | | | | Not Present | 1370 | 160 | |
| 8 | Example | 1160 | 73.0 | | | 27.0 | | | | | | Not Present | 1340 | 180 | |
| 9 | Example | 1150 | 72.1 | | | 27.9 | | | | | | Not Present | 1330 | 180 | |
| 10 | Comparative Example | 1140 | 71.0 | | | 29.0 | | | | | | Not Present | 1328 | 188 | |
| 11 | Comparative Example | 1138 | 70.0 | | | 30.0 | | | | | | Not Present | 1326 | 188 | |
| 12 | Example | 1350 | 89.9 | | 10.0 | | | | | | 0.2 | Present | 1380 | 30 | Al Oxide |
| 13 | Example | 1326 | 89.9 | | | 10.0 | | | | | 0.2 | Present | 1418 | 92 | Al Oxide |
| 14 | Example | 1320 | 88.9 | | | 11.0 | | | | | 0.2 | Present | 1420 | 100 | Al Oxide |
| 15 | Example | 1285 | 84.0 | | 15.9 | | | | | | 0.2 | Present | 1330 | 45 | Al Oxide |
| 16 | Example | 1180 | 72.9 | | | 27.0 | | | | | 0.2 | Present | 1340 | 180 | Al Oxide |
| 17 | Example | 1290 | 98.1 | 0.5 | 1.0 | | 0.2 | | | | 0.2 | Present | 1433 | 143 | Eutectic |
| 18 | Example | 1286 | 96.9 | 1.5 | 1.0 | | 0.3 | | | | 0.3 | Present | 1420 | 134 | Eutectic |
| 19 | Example | 1280 | 95.8 | 1.7 | 1.5 | | 0.2 | | | | 0.8 | Present | 1395 | 115 | Eutectic |
| 20 | Example | 1300 | 97.6 | 0.3 | 1.5 | | | 0.2 | | | 0.4 | Present | 1429 | 129 | Eutectic |
| 21 | Example | 1297 | 97.8 | 0.5 | 0.5 | | | 1.0 | | | 0.2 | Present | 1443 | 146 | Eutectic |
| 22 | Example | 1291 | 96.0 | 0.3 | 1.5 | | | 2.0 | | | 0.2 | Present | 1432 | 141 | Eutectic |
| 23 | Example | 1288 | 93.6 | 1.5 | 1.6 | | | 3.0 | | | 0.3 | Present | 1419 | 131 | Eutectic |
| 24 | Example | 1285 | 97.7 | 1.5 | 0.3 | | | | 0.1 | | 0.4 | Present | 1409 | 124 | Eutectic |
| 25 | Example | 1284 | 98.0 | 1.0 | 0.5 | | | | 0.2 | | 0.3 | Present | 1435 | 151 | Eutectic |
| 26 | Example | 1281 | 97.4 | 1.5 | 0.5 | | | | 0.3 | | 0.3 | Present | 1430 | 149 | Eutectic |
| 27 | Example | 1276 | 97.6 | 1.0 | 1.0 | | | | 0.1 | | 0.3 | Present | 1425 | 149 | Eutectic |
| 28 | Example | 1283 | 95.1 | 2.0 | 1.9 | | | | 0.2 | | 0.8 | Present | 1422 | 139 | Eutectic |
| 29 | Example | 1210 | 97.0 | 1.0 | 1.5 | | | | | 0.2 | 0.3 | Present | 1424 | 214 | Eutectic |

TABLE 2

| No. | | Workability: Ground Electrode without annealing | Workability: Ground Electrode with annealing | Electrode: Consumption | Electrode: Grain Growth | Comprehensive Estimation |
|---|---|---|---|---|---|---|
| | | | | Spark Plug Sample | | |
| 1 | Comparative Example | ○ | ○ | X | X | X |
| 2 | Comparative Example | ○ | ○ | X | X | X |
| 3 | Example | ○ | ◎ | ◎ | ○ | ◎ |
| 4 | Example | ○ | ◎ | ◎ | ○ | ◎ |
| 5 | Example | ○ | ◎ | ◎ | ○ | ◎ |
| 6 | Example | ○ | ◎ | ◎ | ○ | ◎ |
| 7 | Example | ○ | ◎ | ◎ | ○ | ◎ |
| 8 | Example | ○ | ◎ | ◎ | ○ | ◎ |
| 9 | Example | ○ | ◎ | ◎ | ○ | ◎ |
| 10 | Comparative Example | X | ○ | X | X | X |
| 11 | Comparative Example | X | ○ | X | X | X |
| 12 | Example | ○ | ◎ | ◎ | ◎ | ◎ |
| 13 | Example | ○ | ◎ | ◎ | ◎ | ◎ |
| 14 | Example | ◎ | ◎ | ◎ | ◆ | ◎ |
| 15 | Example | ○ | ◎ | ◎ | ◎ | ◎ |
| 16 | Example | ◎ | ◎ | ◎ | ◆ | ◎ |
| 17 | Example | ◆ | ◆ | ◆ | ◆◆ | ◆ |
| 18 | Example | ◆ | ◆ | ◆ | ◆◆ | ◆ |
| 19 | Example | ◆ | ◆ | ◎ | ◆◆ | ◆ |
| 20 | Example | ◆ | ◆ | ◆ | ◆◆ | ◆ |
| 21 | Example | ◆ | ◆ | ◆ | ◆◆ | ◆ |
| 22 | Example | ◆ | ◆ | ◆ | ◆◆ | ◆ |
| 23 | Example | ◆ | ◆ | ◎ | ◆◆ | ◆ |
| 24 | Example | ◆ | ◆ | ◆ | ◆◆ | ◆ |
| 25 | Example | ◆ | ◆ | ◆ | ◆◆ | ◆ |
| 26 | Example | ◆ | ◆ | ◆ | ◆◆ | ◆ |

TABLE 2-continued

| No. | | Workability | | Electrode | | |
|---|---|---|---|---|---|---|
| | | Ground Electrode without annealing | Ground Electrode with annealing | Consumption Spark Plug Sample | Grain Growth | Comprehensive Estimation |
| 27 | Example | ◆ | ◆ | ◆ | ◆◆ | ◆ |
| 28 | Example | ◆ | ◆ | ◎ | ◆◆ | ◆ |
| 29 | Example | ○ | ◎ | ◆ | ◆ | ◎ |

In the ground electrodes without annealing in which the melting points of the outer layers of the ground electrodes were outside the range of the invention, the workability was deteriorated, particularly in Comparative Examples 10 and 11 in which the melting points were lower, the materials were not processed to the shape of the ground electrode. Even in the ground electrodes without annealing in which the melting points of the outer layers were within the range of the invention, in the case where the annealing was not performed, in some cases the workability was not good. However, the ground electrodes could still be processed to the shape of the ground electrode. In the processing of the ground electrodes, any ground electrode could be processed by performing annealing. In addition, in Examples 3 to 9, 12, 13, and 15, the maximum distances of the gaps between the outer layers and the core portions and the maximum diameters of the voids were small, and the workability was improved.

Since the outer layers of Examples 3 to 9 did not contain the precipitates, the average grain diameters of the Ni-based alloy base materials were greater than those of the outer layers of Examples 12 to 29, and the estimations of the grain growth degrees were deteriorated.

In Examples 17 to 29 of Examples 12 to 29 which contained the precipitates, since the precipitates were eutectic structure and were evenly dispersed, the grain growths of the Ni-based alloy base materials were further suppressed.

In the outer layers of Examples 12, 13, 15, 29, the workability of the ground electrodes without the annealing was not so good. The temperature differences between the melting start temperatures and the melting completion temperatures were small to less than 100° C. in Examples 12, 13, and 15, and therefore, the reason why the workability was deteriorated was assumed to be that the dispersion of $Al_2O_3$ was insufficient. The temperature differences between the melting start temperatures and the melting completion temperatures were great to more than 200° C. in Example 29, and therefore, the reason why the workability was deteriorated was assumed to be that the solidification segregations of the Ni-based alloy base materials or the grain growths and the aggregations of the precipitates were generated and the dispersions of the precipitates were deteriorated.

REFERENCE SIGNS LIST

1, 101, 102: spark plug
2: center electrode
3: insulator
4: metal shell
6, 61, 62: ground electrode
7: outer member
8: inner member
9: screw portion
10: talc
11: packing
12, 121, 122: core portion
13, 131, 132: outer layer
142: intermediate layer
G: spark discharge gap

The invention claimed is:

1. A spark plug comprising:

a center electrode and a ground electrode having a gap between the center electrode and the ground electrode, wherein the ground electrode includes an outer layer which is formed from an Ni-based alloy and a core portion which is covered by the outer layer and formed from material having higher thermal conductivity than that of the outer layer, and the melting point of the Ni-based alloy forming the outer layer is 1150° C. or more and 1350° C. or less.

2. The spark plug according to claim 1, wherein the outer layer includes precipitates.

3. The spark plug according to claim 1 wherein a difference between a melting start temperature and a melting completion temperature of the outer layer is 100° C. or more.

4. The spark plug according to any one of claim 1, wherein the outer layer includes precipitates containing a eutectic structure.

5. The spark plug according to any one of claim 1, wherein the outer layer contains 96% by mass or more of Ni, 0.5% by mass or more and 1.5% by mass or less of Mn, and 0.5% by mass or more and 1.5% by mass or less of Si.

* * * * *